US008596965B2

(12) United States Patent
Merry et al.

(10) Patent No.: US 8,596,965 B2
(45) **Date of Patent: *Dec. 3, 2013**

(54) GAS TURBINE ENGINE COMPRESSOR CASE MOUNTING ARRANGEMENT

(75) Inventors: Brian D. Merry, Andover, CT (US); Gabriel L. Suciu, Glastonbury, CT (US); Christopher M. Dye, South Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/294,492

(22) Filed: Nov. 11, 2011

(65) Prior Publication Data

US 2012/0288366 A1 Nov. 15, 2012

Related U.S. Application Data

(63) Continuation of application No. 11/858,988, filed on Sep. 21, 2007, now Pat. No. 8,075,261.

(51) Int. Cl.
*F01D 1/00* (2006.01)

(52) U.S. Cl.
USPC ..... 415/122.1

(58) Field of Classification Search
None
See application file for complete search history.

(56) References Cited

U.S. PATENT DOCUMENTS 8,075,261 B2 * 12/2011 Merry et al. ..... 415/201

* cited by examiner

*Primary Examiner* — Richard Edgar
(74) *Attorney, Agent, or Firm* — Carlson, Gaskey & Olds P.C.

(57) ABSTRACT

A compressor case support arrangement for a gas turbine engine includes a fan section having a central axis and a compressor case for housing a compressor. An inlet case guides air to the compressor. The compressor case is positioned axially further from the fan section than the inlet case. A support member extends between the fan section and the compressor case. The support member restricts movement of the compressor case relative to the inlet case. The support member is positioned axially further from the fan section than the plumbing access area.

13 Claims, 4 Drawing Sheets

GAS TURBINE ENGINE COMPRESSOR CASE MOUNTING ARRANGEMENT

REFERENCE TO RELATED APPLICATIONS

This application is a continuation application of U.S. patent application Ser. No. 11/858,988, filed Sep. 21, 2007 now U.S. Pat. No. 8,075,261.

BACKGROUND OF THE INVENTION

The present invention relates generally to a mounting arrangement for a compressor case assembly in a gas turbine engine.

Gas turbine engines are known, and typically include a compressor for compressing air and delivering it downstream into a combustion section. A fan may move air to the compressor. The compressed air is mixed with fuel and combusted in the combustion section. The products of this combustion are then delivered downstream over turbine rotors, which are driven to rotate and provide power to the engine.

The compressor includes rotors moving within a compressor case to compress air. Maintaining close tolerances between the rotors and the interior of the compressor case facilitates air compression.

Gas turbine engines may include an inlet case for guiding air into a compressor case. The inlet case is mounted adjacent the fan section. Movement of the fan section, such as during in-flight maneuvers, may move the inlet case. Some prior gas turbine engine designs support a front portion of the compressor with the inlet case while an intermediate case structure supports a rear portion of the compressor. In such an arrangement, movement of the fan section may cause at least the front portion of the compressor to move relative to other portions of the compressor.

Disadvantageously, relative movement between portions of the compressor may vary rotor tip and other clearances within the compressor, which can decrease the compression efficiency. Further, supporting the compressor with the inlet case may complicate access to some plumbing connections near the inlet case.

It would be desirable to reduce relative movement between portions of the compressor and to simplify accessing plumbing connection in a gas turbine engine.

SUMMARY OF THE INVENTION

In one example, a compressor case support arrangement for a gas turbine engine includes a fan section having a central axis and a compressor case for housing a compressor. An inlet case guides air to the compressor. The compressor case is positioned axially further from the fan section than the inlet case. A support member extends between the fan section and the compressor case. The support member restricts movement of the compressor case relative to the inlet case.

In another example, a compressor case support arrangement for a gas turbine engine includes a fan section having a central axis, a plumbing access area, and a compressor case for housing a compressor. An inlet case guides air to the compressor. The compressor case is positioned axially further from the fan section than the inlet case. A support member extends between the fan section and the compressor case, the support member is positioned axially further from the fan section than the plumbing access area.

BRIEF DESCRIPTION OF THE DRAWINGS

The various features and advantages of this invention will become apparent to those skilled in the art from the following detailed description of an embodiment. The drawings that accompany the detailed description can be briefly described as follows.

DETAILED DESCRIPTION OF THE PREFERRED EMBODIMENT

Figure 1:
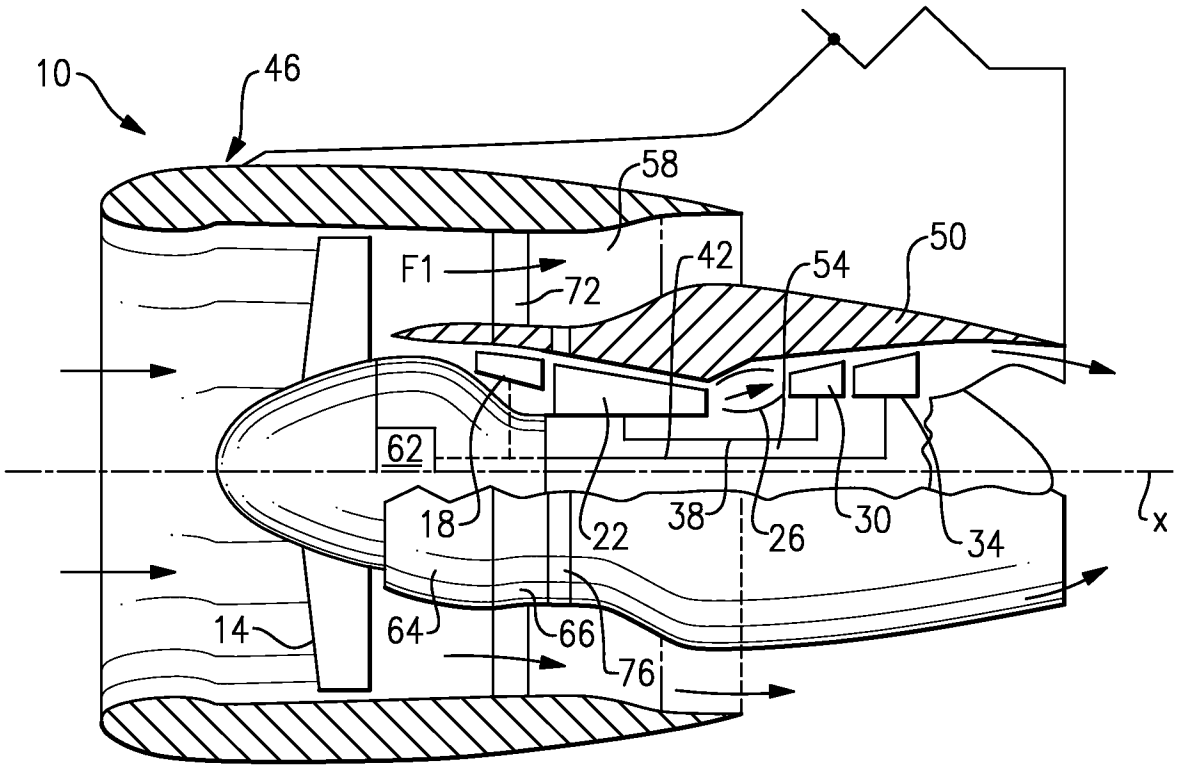
FIG. 1 illustrates a schematic sectional view of a gas turbine engine.

FIG. 1 schematically illustrates an example gas turbine engine 10 including (in serial flow communication) a fan section 14, a low pressure compressor 18, a high pressure compressor 22, a combustor 26, a high pressure turbine 30 and a low pressure turbine 34. The gas turbine engine 10 is circumferentially disposed about an engine centerline X. During operation, air is pulled into the gas turbine engine 10 by the fan section 14, pressurized by the compressors 18, 22 mixed with fuel, and burned in the combustor 26. Hot combustion gases generated within the combustor 26 flow through high and low pressure turbines 30, 34, which extract energy from the hot combustion gases.

In a two-spool design, the high pressure turbine 30 utilizes the extracted energy from the hot combustion gases to power the high pressure compressor 22 through a high speed shaft 38, and a low pressure turbine 34 utilizes the energy extracted from the hot combustion gases to power the low pressure compressor 18 and the fan section 14 through a low speed shaft 42. However, the invention is not limited to the two-spool gas turbine architecture described and may be used with other architectures such as a single-spool axial design, a three-spool axial design and other architectures. That is, there are various types of gas turbine engines, many of which could benefit from the examples disclosed herein, which are not limited to the design shown.

The example gas turbine engine 10 is in the form of a high bypass ratio turbine engine mounted within a nacelle or fan casing 46, which surrounds an engine casing 50 housing a core engine 54. A significant amount of air pressurized by the fan section 14 bypasses the core engine 54 for the generation of propulsion thrust. The airflow entering the fan section 14 may bypass the core engine 54 via a fan bypass passage 58 extending between the fan casing 46 and the engine casing 50 for receiving and communicating a discharge airflow F1. The high bypass flow arrangement provides a significant amount of thrust for powering an aircraft.

The gas turbine engine 10 may include a geartrain 62 for controlling the speed of the rotating fan section 14. The geartrain 62 can be any known gear system, such as a planetary gear system with orbiting planet gears, a planetary system with non-orbiting planet gears or other type of gear system. The low speed shaft 42 may drive the geartrain 62. In the disclosed example, the geartrain 62 has a constant gear ratio. It should be understood, however, that the above parameters are only exemplary of a contemplated geared gas turbine engine 10. That is, the invention is applicable to traditional turbine engines as well as other engine architectures.

The example engine casing 50 generally includes at least an inlet case portion 64, a low pressure compressor case portion 66, and an intermediate case portion 76. The inlet case 64 guides air to the low pressure compressor case 66.

Figure 2:
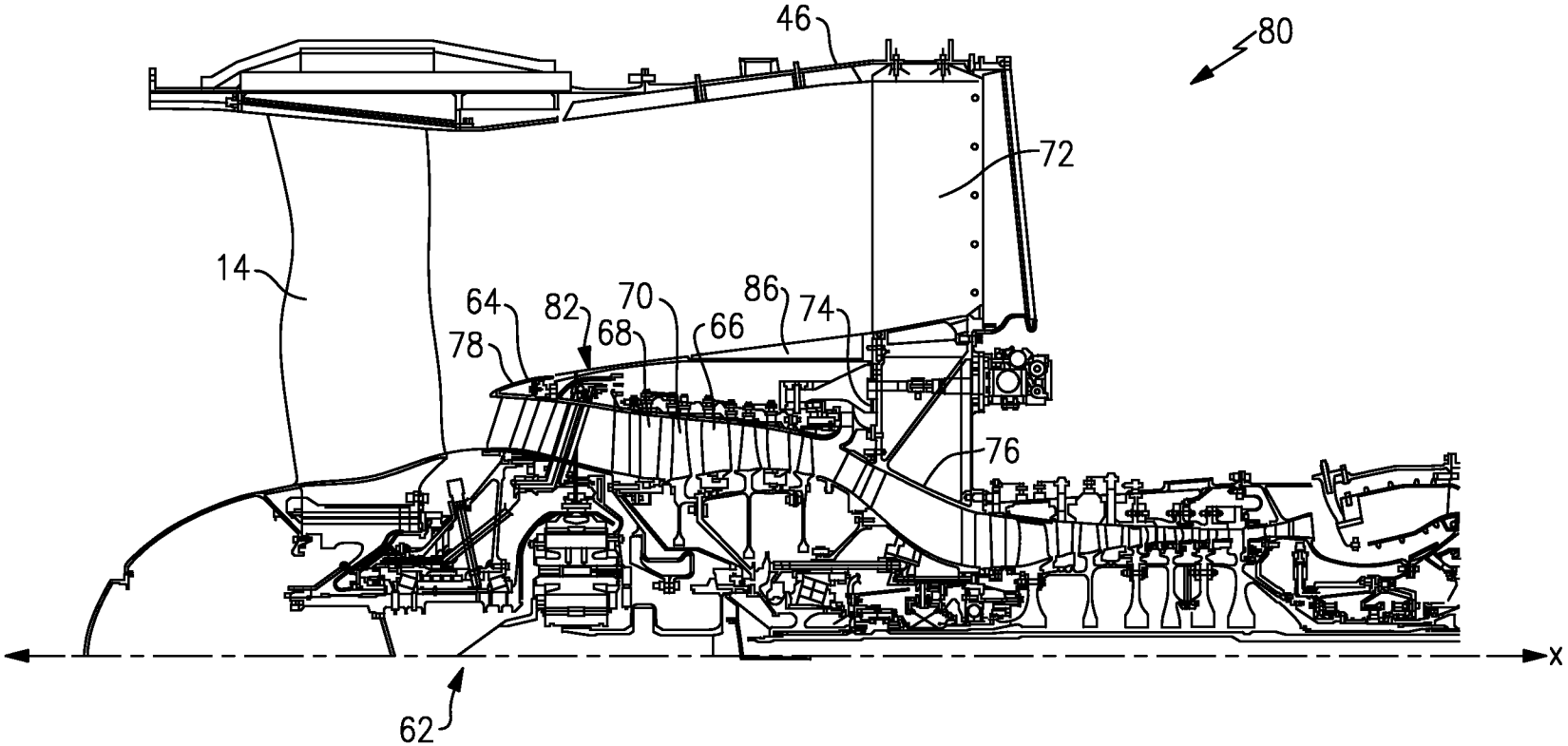
FIG.2 Prior Art
FIG. 2 illustrates a sectional view of a prior art compressor case mounting arrangement.

As shown in FIG. 2, the low pressure compressor case 66 in an example prior art gas turbine engine 80 supports a plurality of compressor stator vanes 68. A plurality of rotors 70 rotate about the central axis X, and, with the compressor stator vanes 68, help compress air moving through the low pressure compressor case 66.

A plurality of guide vanes 72 secure the intermediate case 76 to the fan casing 46. Formerly, the guide vanes 72 each included at least a rear attachment 74 and a forward attachment 78. The rear attachment 74 connects to an intermediate case 76 while the forward attachment 78 connects to the inlet case 64. The lower pressure compressor case 66 was thus supported through the intermediate case 76 and the inlet case 64.

In the prior art, a plumbing connection area 82 is positioned between the rear attachment 74 and the forward attachment 78. The plumbing connection area 82 includes connections used for maintenance and repair of the gas turbine engine 80, such as compressed air attachments, oil attachments, etc. The forward attachment 78 extends to the inlet case 64 from at least one of the guide vanes 72 and covers portions of the plumbing connection area 82. A fan stream splitter 86, a type of cover, typically attaches to the forward attachment 78 to shield the plumbing connection area 82.

Figure 3:
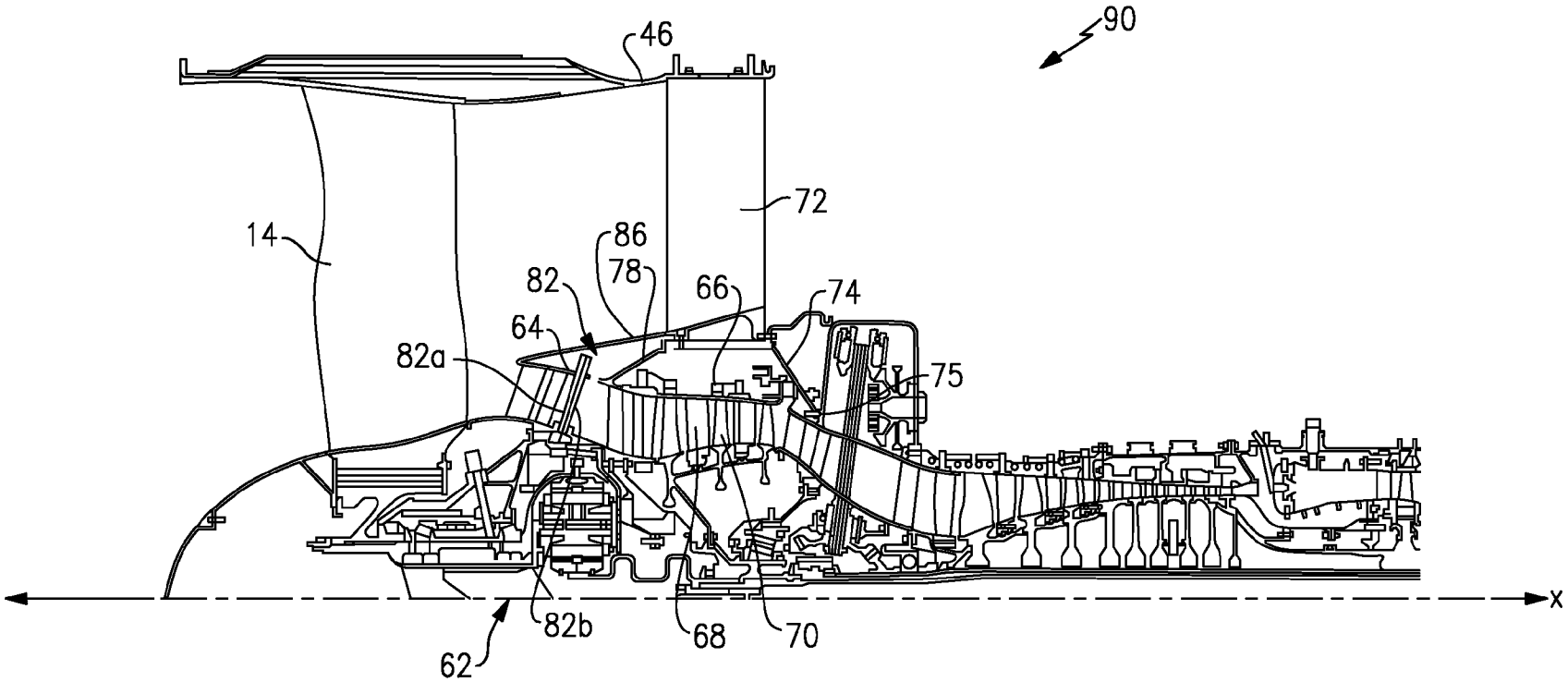
FIG. 3 illustrates a sectional view of an example compressor case mounting arrangement of the current invention.

Referring now to an example of the present invention, in the turbine engine 90 of FIG. 3, the forward attachment 78 attaches to a front portion of the low pressure compressor case 66. In this example, the forward attachment 78 extends from the guide vane 72 to support the low pressure compressor case 66. Together, the forward attachment 78 and guide vane 72 act as a support member for the low pressure compressor case 66. The plumbing connection area 82 is positioned upstream of the forward attachment 78 facilitating access to the plumbing connection area 82. In this example, an operator may directly access the plumbing connection area 82 after removing the fan stream splitter 86. The plumbing connection area 82 typically provides access to a lubrication system 82*a*, a compressed air system 82*b*, or both. The lubrication system 82*a* and compressed air system 82*b* are typically in fluid communication with the geartrain 62.

Maintenance and repair of the geartrain 62 may require removing the geartrain 62 from the engine 90. Positioning the plumbing connection area 82 ahead of the forward attachment 78 simplifies maintenance and removal of the geartrain 62 from other portions of the engine 90. Draining oil from the geartrain 62 prior to removal may take place through the plumbing connection area 82 for example. The plumbing connection area 82 is typically removed with the geartrain 62. Thus, the arrangement may permit removing the geartrain 62 on wing or removing the inlet case 64 from the gas turbine engine 90 separately from the low pressure compressor case 66. This reduces the amount of time needed to prepare an engine for continued revenue service, saving an operator both time and money.

Connecting the forward attachment 78 to the low pressure compressor case 66 helps maintain the position of the rotor 70 relative to the interior of the low pressure compressor case 66 during fan rotation, even if the fan section 14 moves. In this example, the intermediate case 76 supports a rear portion of the low pressure compressor case 66 near a compressed air bleed valve 75.

Figure 4:
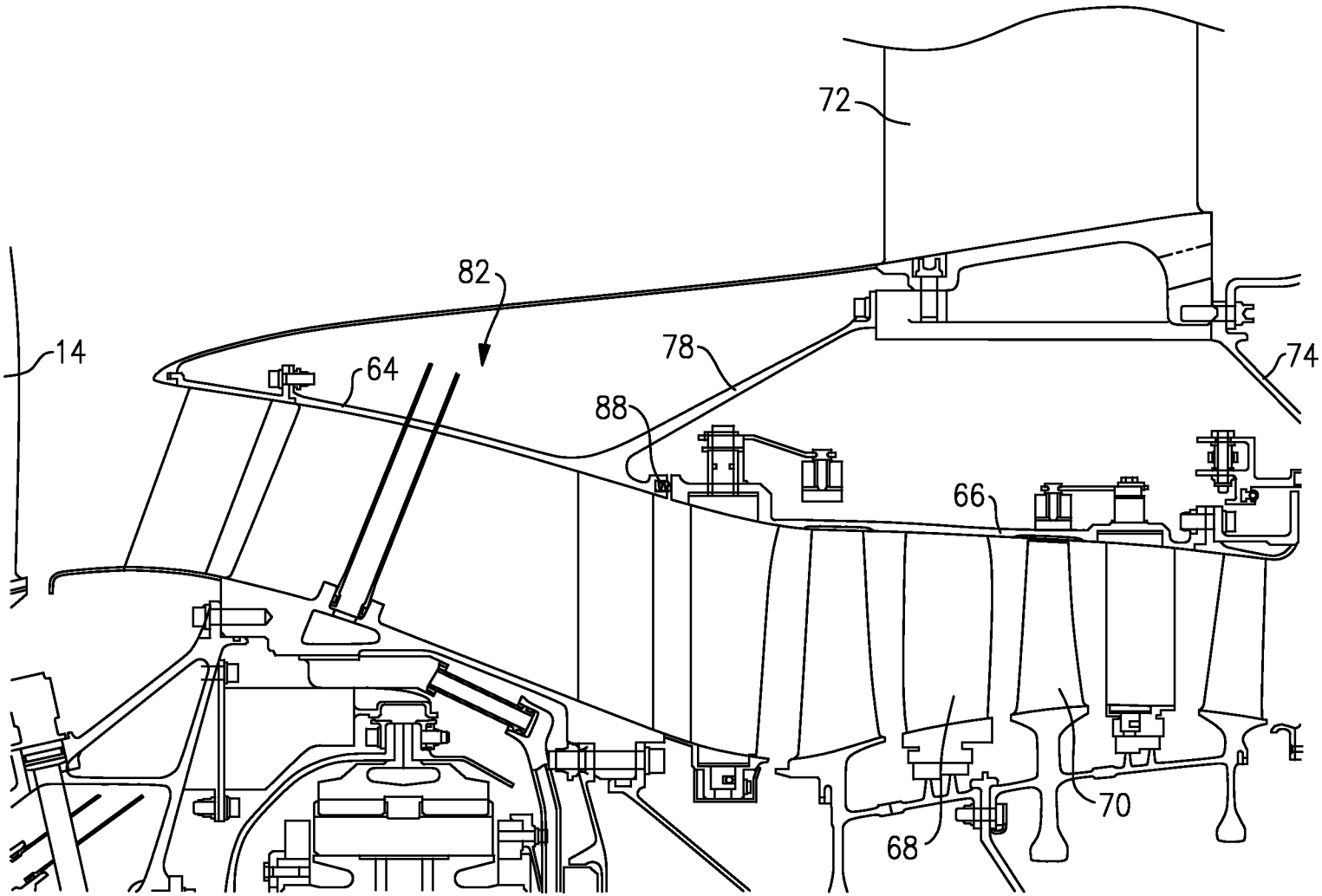
FIG. 4 illustrates a close up sectional view of the intersection between an inlet case and a low pressure compressor case.

As shown in FIG. 4, a seal 88, such as a "W" seal, may restrict fluid movement between the inlet case 64 and the low pressure compressor case 66. In this example, the seal 88 forms the general boundary between the inlet case 64 and the low pressure compressor case 66, while still allowing some amount movement between the cases.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A compressor case support arrangement for a gas turbine engine comprising:

a fan section having a central axis;

a compressor case for housing a compressor;

an inlet case for guiding air to said compressor, said compressor case positioned axially further from said fan section than said inlet case; and a support member extending between said fan section and said compressor case, wherein said support member restricts movement of said compressor case relative to said inlet case, wherein said compressor case includes a front compressor case portion and a rear compressor case portion, said rear compressor case portion being axially further from said inlet case than said front compressor case portion, wherein said support member extends between said fan section and said front compressor case portion, wherein said inlet case is removable from said gas turbofan engine separately from said compressor case.

2. The compressor case support arrangement of claim 1, including an intermediate case for supporting said rear compressor case portion.

3. The compressor case support arrangement of claim 2, wherein said intermediate case supports said rear compressor case portion adjacent a bleed ring.

4. The compressor case support arrangement of claim 1, wherein said inlet case is removable from said gas turbofan engine separately from said compressor case.

5. The compressor case support arrangement of claim 1, including a seal adjacent a front portion of said compressor case, said seal for restricting fluid movement between said compressor case and said inlet case.

6. The compressor case support arrangement of claim 5, wherein said seal permits relative movement between said compressor case and said inlet case.

7. The compressor case support arrangement of claim 6, wherein said seal is a "W" seal.

8. The compressor case support arrangement of claim 1, wherein said compressor case houses a low pressure compressor.

9. The compressor case support arrangement of claim 1, including a plumbing access area positioned between said fan section and said support member.

10. The compressor case support arrangement of claim 1, wherein said support member comprises a guide vane.

11. A compressor case support arrangement for a gas turbine engine comprising:

a fan section having a central axis;

a plumbing access area;

a compressor case for housing a compressor;

an inlet case for guiding air to said compressor; and a support member extending between said fan section and said compressor case, said support member positioned axially further from said fan section than said plumbing access area wherein said plumbing access area includes at least one of an air connection and an oil connection, wherein said inlet case includes said plumbing access area.

12. The compressor support arrangement of claim 11, including a cover for covering at least a portion of said plumbing access area.

13. The compressor case support arrangement of claim 11, wherein said support member comprises a guide vane.

* * * * *